US010364806B2

(12) United States Patent
Dyminski

(10) Patent No.: US 10,364,806 B2
(45) Date of Patent: Jul. 30, 2019

(54) HYDROSTATIC PUMP BARREL WITH SLOPED KIDNEY PORTS

(71) Applicant: Parker-Hannifin Corporation, Cleveland, OH (US)

(72) Inventor: Daniel Dyminski, Portage, MI (US)

(73) Assignee: Parker-Hannifin Corporation, Cleveland, OH (US)

( * ) Notice: Subject to any disclaimer, the term of this patent is extended or adjusted under 35 U.S.C. 154(b) by 148 days.

(21) Appl. No.: 15/510,357

(22) PCT Filed: Dec. 2, 2015

(86) PCT No.: PCT/US2015/063396
§ 371 (c)(1),
(2) Date: Mar. 10, 2017

(87) PCT Pub. No.: WO2016/105890
PCT Pub. Date: Jun. 30, 2016

(65) Prior Publication Data

US 2017/0298912 A1 Oct. 19, 2017

Related U.S. Application Data

(60) Provisional application No. 62/151,491, filed on Apr. 23, 2015, provisional application No. 62/095,862, filed on Dec. 23, 2014.

(51) Int. Cl.
*F04B 1/20* (2006.01)
*F04B 1/04* (2006.01)
(Continued)

(52) U.S. Cl.
CPC ..... *F04B 1/2021* (2013.01); *F03C 1/0636* (2013.01); *F04B 1/0421* (2013.01);
(Continued)

(58) Field of Classification Search
CPC ..... F04B 1/0421; F04B 1/10; F04B 1/113; F04B 1/1133; F04B 1/20; F04B 1/2007;
(Continued)

(56) References Cited

U.S. PATENT DOCUMENTS 5,058,485 A 10/1991 Cardillo
2010/0178177 A1 7/2010 Yokoyama et al.
2010/0287926 A1* 11/2010 Ogasawara ..... F01P 5/04 60/487

FOREIGN PATENT DOCUMENTS

DE 4035748 A1 * 5/1991 ..... F04B 1/2035

OTHER PUBLICATIONS

International Search Report and Written Opinion for International Application No. PCT/US2015/063396, dated Mar. 17, 2016.

* cited by examiner

*Primary Examiner* — Alexander B Comley
*Assistant Examiner* — Chirag Jariwala
(74) *Attorney, Agent, or Firm* — Renner, Otto, Boisselle & Sklar, LLP

(57) ABSTRACT

A pump barrel (70) for use in a hydrostatic pump assembly includes a barrel body (88) defining a plurality of piston bores (84) that receive a plurality of pistons moveable within the bores, and a porting face (74) that defines a plurality of ports (72) in fluid communication with the piston bores and providing fluid flow paths into and out from the barrel body. Each port (72) has a leading edge surface and a trailing edge surface relative to a direction of rotation of the pump barrel, said leading and trailing edge surfaces being oriented in a first direction (along line 6-6) at non-right angles relative to the porting face (74). Each port (72) has an inner edge surface (80) and an outer edge surface (82) relative to a radial direction of the pump barrel, said inner and outer edge surfaces (80,82) being oriented in a second direction (along
(Continued)

line 9-9) comprising a tilt angle (90,92) relative to the porting face (74) that is different from the angles in the first direction. A hydrostatic pump assembly incorporating such a pump barrel (70) is also disclosed.

20 Claims, 10 Drawing Sheets

(51) Int. Cl.

| | |
|---|---|
| ***F04B 27/08*** | (2006.01) |
| ***F04B 39/12*** | (2006.01) |
| ***F04B 53/16*** | (2006.01) |
| ***F03C 1/06*** | (2006.01) |

(52) U.S. Cl.
CPC ..... *F04B 1/20* (2013.01); *F04B 1/2035* (2013.01); *F04B 27/0826* (2013.01); *F04B 27/0834* (2013.01); *F04B 39/122* (2013.01); *F04B 53/162* (2013.01)

(58) Field of Classification Search
CPC ..... F04B 1/2021; F04B 1/2035; F04B 1/30; F04B 1/32; F04B 1/324; F04B 27/08; F04B 27/0826; F04B 27/0834; F04B 27/20–22; F04B 39/122–123; F04B 53/162; F03C 1/20; F03C 1/2007; F03C 1/2021; F03C 1/2035
USPC ..... 417/222.1–222.2, 271; 92/12.1–13; 91/472, 499, 505
See application file for complete search history.

HYDROSTATIC PUMP BARREL WITH SLOPED KIDNEY PORTS

RELATED APPLICATIONS

This application is a national phase of International Patent Application Serial No. PCT/US2015/063396, filed on Dec. 2, 2015 which claims the benefit of U.S. Provisional Application No. 62/095,862 filed on Dec. 23, 2014, and U.S. Provisional Application No. 62/151,491 filed on Apr. 23, 2015, the contents of which are hereby incorporated by reference.

FIELD OF INVENTION

The present invention relates generally to hydrostatic pumps, and more particularly to piston barrel configurations for use in such hydrostatic pumps.

BACKGROUND

Hydrostatic pumps convert the mechanical energy transmitted by a prime mover into hydraulic energy through the pumping of hydraulic fluid. A common type of hydrostatic or hydraulic pump is an axial piston-type pump including a plurality of reciprocating pistons housed within a rotating pump barrel, and which are in fluid communication through hydraulic porting with system components or actuators. Rotation of the hydraulic pump barrel relative to a moveable swash plate creates an axial motion of the pump pistons that forces hydraulic fluid through the hydraulic porting to the other system components.

As referenced above, the pumping action of the pistons is realized by means of the pistons reciprocating axially in and out of a rotating cylinder pump barrel by interaction against a swash plate. The maximum rotational speed at which barrel chambers fill completely with working fluid under atmospheric pressure is called the "self-priming speed". The self-priming speed is a significant parameter that provides a measure of performance of the pump. A higher self-priming speed means more output power, as power has a linear relationship to output flow (speed). Higher self-priming speed allows operation at higher speeds without cavitation, or operation at lower inlet pressure for a given speed such as is desirable at higher elevations.

Accordingly, it is desirable to achieve as high of a self-priming speed as possible to increase the output power. One option to increase the output power is simply to increase flow by increasing the speed of rotation of the pump barrel. However, increasing output flow merely by increasing the pump speed is limited by the filling capacity of the pump, which decreases with the pump speed due to decreased inlet pressure.

Other alternatives have been employed to increase output flow. For a given self-priming speed, a larger pump may be employed to increase the output power, but spatial considerations may preclude use of a larger pump. Multiple pump configurations also have been employed to generate a higher output power. In a typical configuration, a second impeller style pump may be employed in combination with a piston-barrel style hydrostatic pump. The use of the second impeller pump permits increasing the speed of rotation of the barrel by increasing fluid pressure at the inlet of the barrel, and otherwise can improve inlet conditions to prevent cavitation issues (which is particularly useful at high altitudes). The multiple pump configurations, however, have a disadvantage in that the number of components increases, which in turn increases the size, cost, and maintenance issues associated with the pump system. Accordingly, conventional mechanisms for increasing the output power of a hydrostatic or hydraulic pump have proven to be deficient.

SUMMARY OF INVENTION

The hydrostatic or hydraulic pump of the present invention provides for enhanced output power without increased pump size, and without a multiple pump configuration. Increased output power is achieved by employing sloped kidney port surfaces in the pump barrel, which enhances the flow through the pump and allows increased rotational speed as compared to conventional configurations. The sloped kidney port surfaces take advantage of a pressure differential between the trailing edge of the kidney port and the leading edge of the kidney port. The sloped surfaces utilize the higher pressure at the trailing edge of the kidney port to push the fluid under an inertia force more easily into the piston chamber. This results in enhanced flow of the working fluid through the pump, and thus a higher self-priming speed, which in turn increases the output power of the pump as compared to conventions configurations.

An aspect of the invention is a pump barrel for use in a hydrostatic pump assembly. In exemplary embodiments, the pump barrel may include a barrel body defining a plurality of piston bores configured for receiving a plurality of pistons that are moveable within the bores, and a porting face that defines a plurality of ports that are in fluid communication with the piston bores and providing fluid flow paths into and out from the barrel body. Edge surfaces of the ports are oriented in a first direction at non-right angles relative to the porting face. More specifically, each port has a leading edge surface and a trailing edge surface relative to a direction of rotation of the pump barrel. The leading edge surface may be oriented at an angle of less than 90° relative to the porting face, and the trailing edge surface may be oriented at an angle greater than 90° relative to the porting face.

In exemplary embodiments of the pump barrel, the edge surfaces of the ports further may be oriented in a second direction comprising a tilt angle that is different from the first direction. The tilt angle tilts the ports in a plane that is perpendicular to both the porting face and a plane of the non-right angles of the first direction.

The piston barrel may be incorporated into a hydrostatic pump assembly. In exemplary embodiments, the hydrostatic pump assembly includes a piston rotating group including the pump barrel defining a plurality of bores, and a plurality of moveable pistons that are received in the plurality of bores of the pump barrel. The hydrostatic pump assembly further includes an input shaft for driving rotation of the piston rotating group, and a displaceable swash plate, wherein as the piston rotating group rotates, the pistons extend and contract by interaction against the swash plate to drive fluid into and out from the hydrostatic pump assembly. The pump barrel has a plurality of ports in fluid communication with the bores and providing fluid flow paths into and out from the barrel, and edge surfaces of the ports are sloped in a first direction relative to a normal line extending along an axis of movement of the pistons.

In exemplary embodiments of the hydrostatic pump assembly, the edge surfaces of the ports further may be oriented in a second direction comprising a tilt angle that is different from the first direction. The tilt angle tilts the ports in a plane that is perpendicular to both the porting face and a plane of the sloping of the first direction.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the claims appended hereto. Features that are described and/or illustrated with respect to one embodiment may be used in the same way or in a similar way in one or more other embodiments and/or in combination with or instead of the features of the other embodiments.

DETAILED DESCRIPTION

Figure 1:
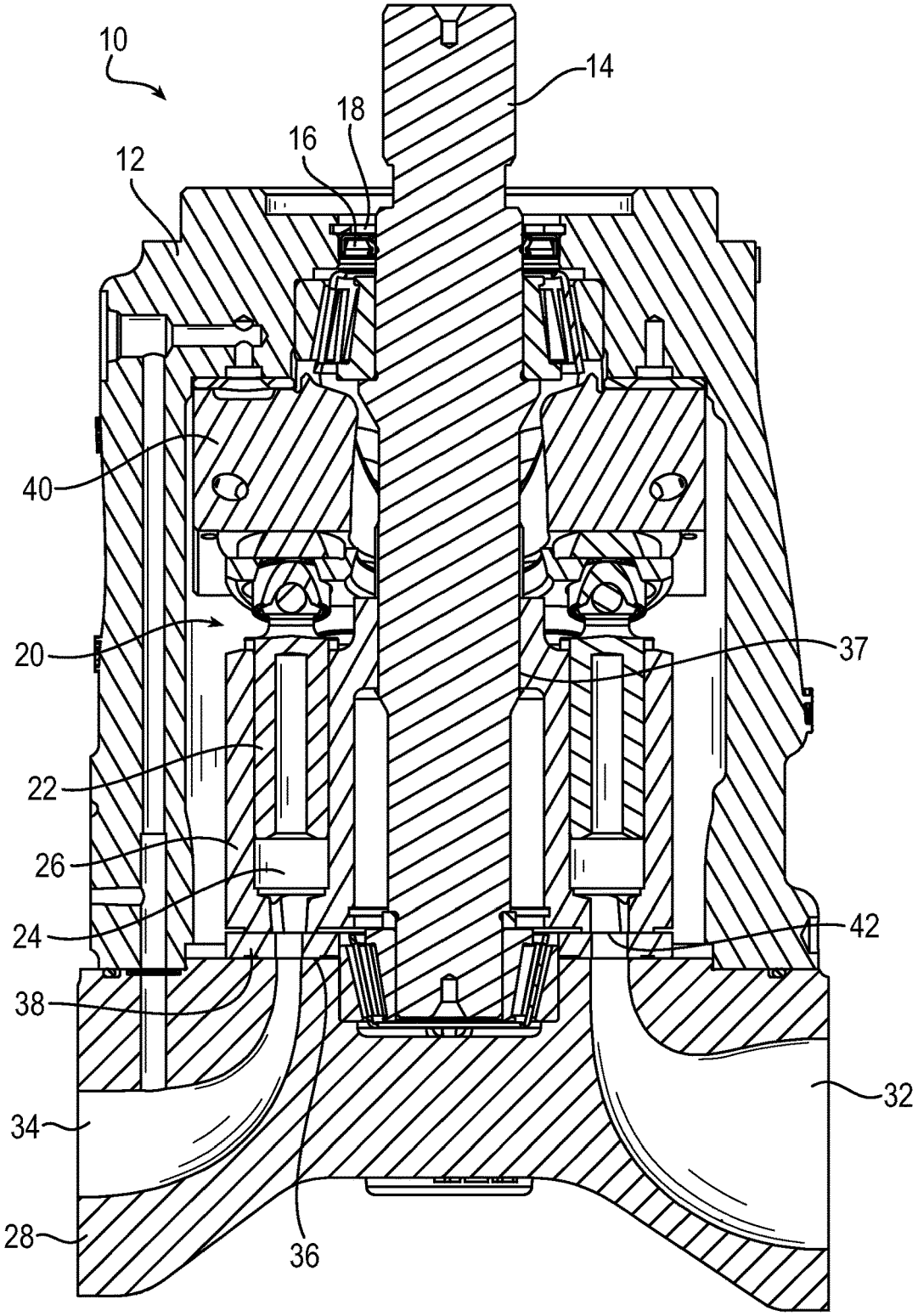
FIG. 1 is a drawing depicting a side cross-sectional view of an exemplary hydrostatic pump assembly in accordance with embodiments of the present invention.

Embodiments of the present invention will now be described with reference to the drawings, wherein like reference numerals are used to refer to like elements throughout. It will be understood that the figures are not necessarily to scale.

As further described below, as aspect of the invention is a hydrostatic pump assembly. In exemplary embodiments, the hydrostatic pump assembly includes a piston rotating group including a pump barrel defining a plurality of bores, and a plurality of moveable pistons that are received in the plurality of bores of the pump barrel. The hydrostatic pump assembly further includes an input shaft for driving rotation of the piston rotating group, and a displaceable swash plate, wherein as the piston rotating group rotates, the pistons extend and contract by interaction against the swash plate to drive fluid into and out from the hydrostatic pump assembly. The pump barrel has a plurality of ports in fluid communication with the bores and providing fluid flow paths into and out from the pump barrel, and edge surfaces of the ports are sloped relative to a normal line extending along an axis of movement of the pistons.

FIG. 1 is a drawing depicting a side cross-sectional view of an exemplary hydrostatic or hydraulic pump assembly 10 in accordance with embodiments of the present invention. The pump assembly 10 includes a housing 12 that supports an input shaft 14 that is sealed with a shaft seal 16 and retaining ring 18. A piston rotating group 20 includes a plurality of moveable pistons 22 housed within piston chambers 24 configured as a plurality of corresponding bores that are defined by a pump barrel 26. The pump assembly 10 is secured to a fluid manifold 28 that includes an input passage 32 and an output passage 34 respectively for communicating a working fluid to and from the pump assembly 10. In exemplary embodiments, the working fluid is hydraulic fluid as is known in the art. The input shaft 14 drives the piston rotating group 20 such that the piston rotating group 20 rotates against a pump running face 42 of a valve plate 38 that is attached to the mainfold. The pump barrel 26 may include a spline 37 that interacts with a cooperating spline on the end of the input shaft 14.

In operation, an operator effects control via an input lever (not shown) that operates though a trunion arm as known in the art, which causes a displacement of a displaceable swash plate 40. For example, the swash plate may displace within an angular range of ±14°. As the piston rotating group rotates under the driving force of the input shaft, the pistons 22 extend and contract by interaction against the swash plate to drive the hydraulic fluid into and out from the pump barrel so as to pump the hydraulic fluid through the manifold 28 to downstream system components. As a piston retracts, under the negative pressure fluid is drawn from the input passage 32 through one of the ports 42 defined by the pump barrel 26, and into the piston chamber. The ports 42 typically may be kidney shaped, and therefore are commonly referred to as kidney ports. As the piston extends, fluid is forced through another one of the kidney ports 42 in the pump barrel 26 and out from the piston chamber, and then through the output passage 34.

Figure 2:
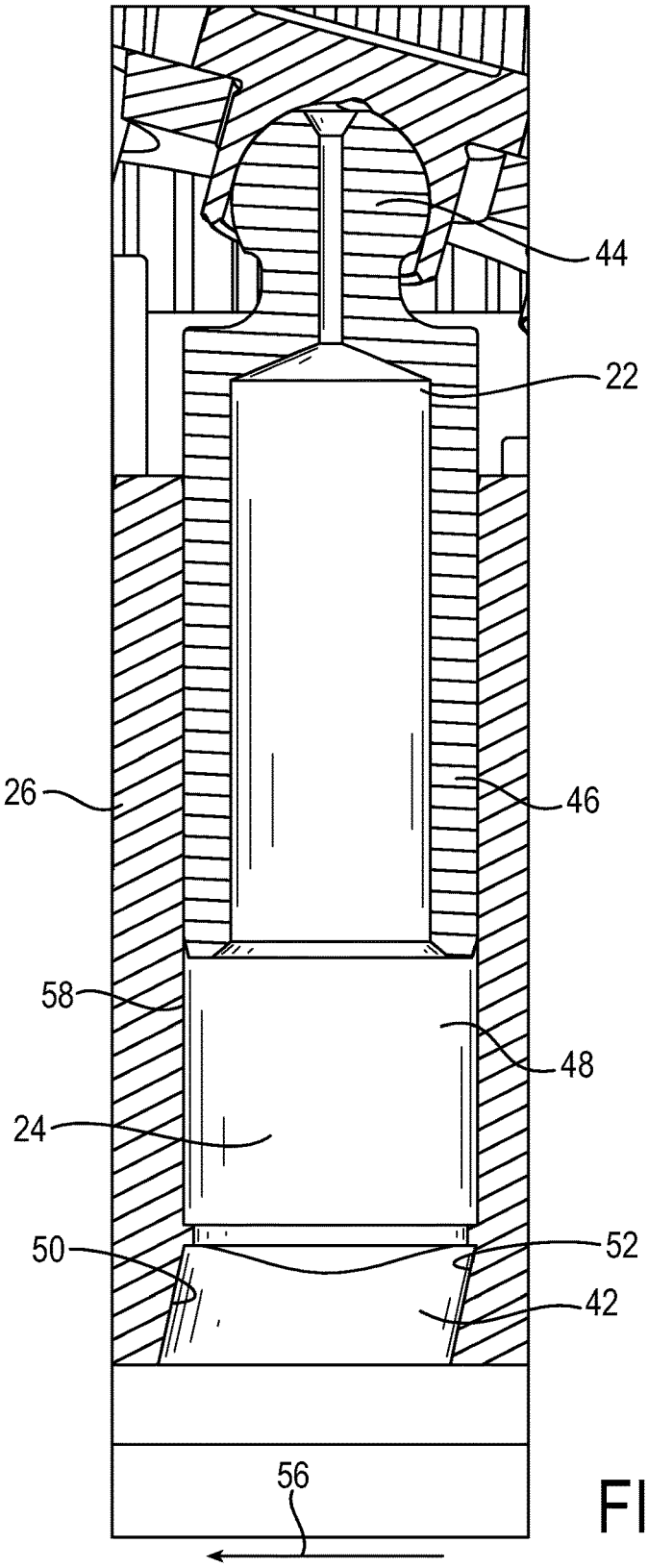
FIG. 2 is a drawing depicting a side cross-sectional view of a portion of the pump assembly of FIG. 1 including one of the piston chambers and pistons.

FIG. 2 is a drawing depicting a side cross-sectional view of a portion of the pump assembly of FIG. 1 including one of the piston chambers 24 with a piston 22. The piston chamber 24 is configured as a cylinder in which the piston 22 is moveably housed. The piston chamber 24 is contained within a bore defined by the pump barrel 26. The piston 22 includes a spherical piston head 44 and a cylindrical rod 46 that is moveable in an axial direction within the piston chamber 24. The retraction and extension of the piston 22 drives the working fluid into and out from a fluid chamber 48. The fluid chamber 48 is in fluid communication with one of the kidney ports 42 that is defined by the pump barrel 26, which as referenced above rotates against a pump running face 36 of the fluid manifold 28.

As further detailed below, the kidney port 42 is defined by the pump barrel 26 to have a leading edge surface 50 and a trailing edge surface 52. The leading edge surface 50 and trailing edge surface 52 are sloped relative to a wall surface 58 of bores that receive the pistons 22, or relative to a normal line that extends along an axis of movement of the piston 22. This configuration is in contrast to conventional pump barrels, in which the leading and trailing edge surfaces are non-sloped and straight.

As further detailed below, in exemplary embodiments, the pump barrel may include a barrel body defining a plurality of piston bores configured for receiving a plurality of pistons that are moveable within the bores, and a porting face that defines a plurality of ports that are in fluid communication with the piston bores and providing fluid flow paths into and out from the barrel body. Edge surfaces of the ports are oriented at non-right angles relative to the porting face. More specifically, each port has a leading edge surface and a trailing edge surface relative to a direction of rotation of the pump barrel. The leading edge surface may be oriented at an angle of less than 90° relative to the porting face, and the trailing edge surface may be oriented at an angle greater than 90° relative to the porting face.

Figure 3:
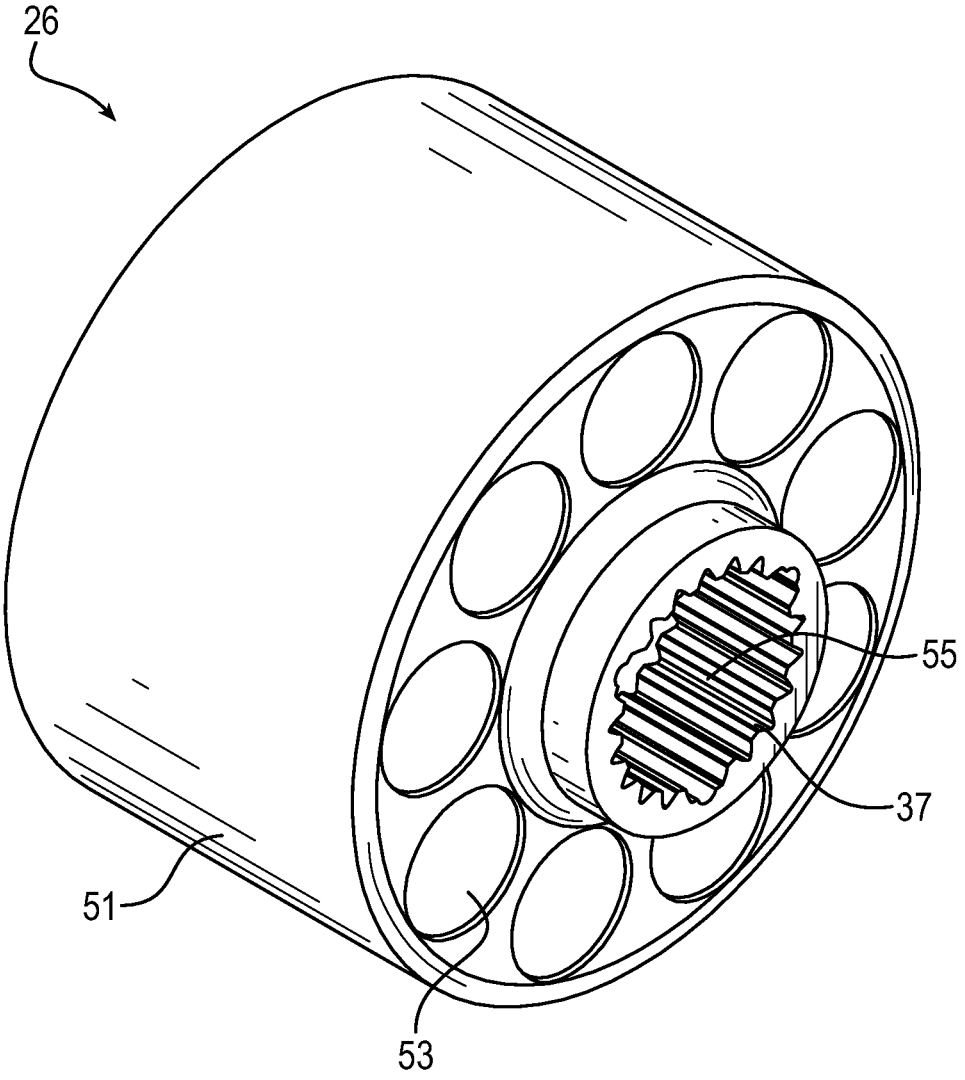
FIG. 3 is a drawing depicting a first perspective view of an exemplary pump barrel for a hydrostatic pump in accordance with embodiments of the present invention.

FIG. 3 is a drawing depicting a first perspective view of an exemplary pump barrel 26 for the hydrostatic pump assembly 10 in accordance with embodiments of the present invention. The pump barrel 26 has a generally cylindrical barrel body 51 and defines a plurality of piston bores 53 that receive a corresponding number of the piston chambers with the pistons as referenced above. The piston bores 53 also may be cylindrical to receive corresponding cylindrically shaped pistons. The depiction of FIG. 3 is from the viewpoint of the end that receives the input shaft. FIG. 3 shows the spline 37 which extends through a central bore 55 the piston barrel 26, and which interacts with the input shaft for driving the pump barrel. The piston bores 53 may be spaced equidistantly around the central bore 55.

Figure 4:
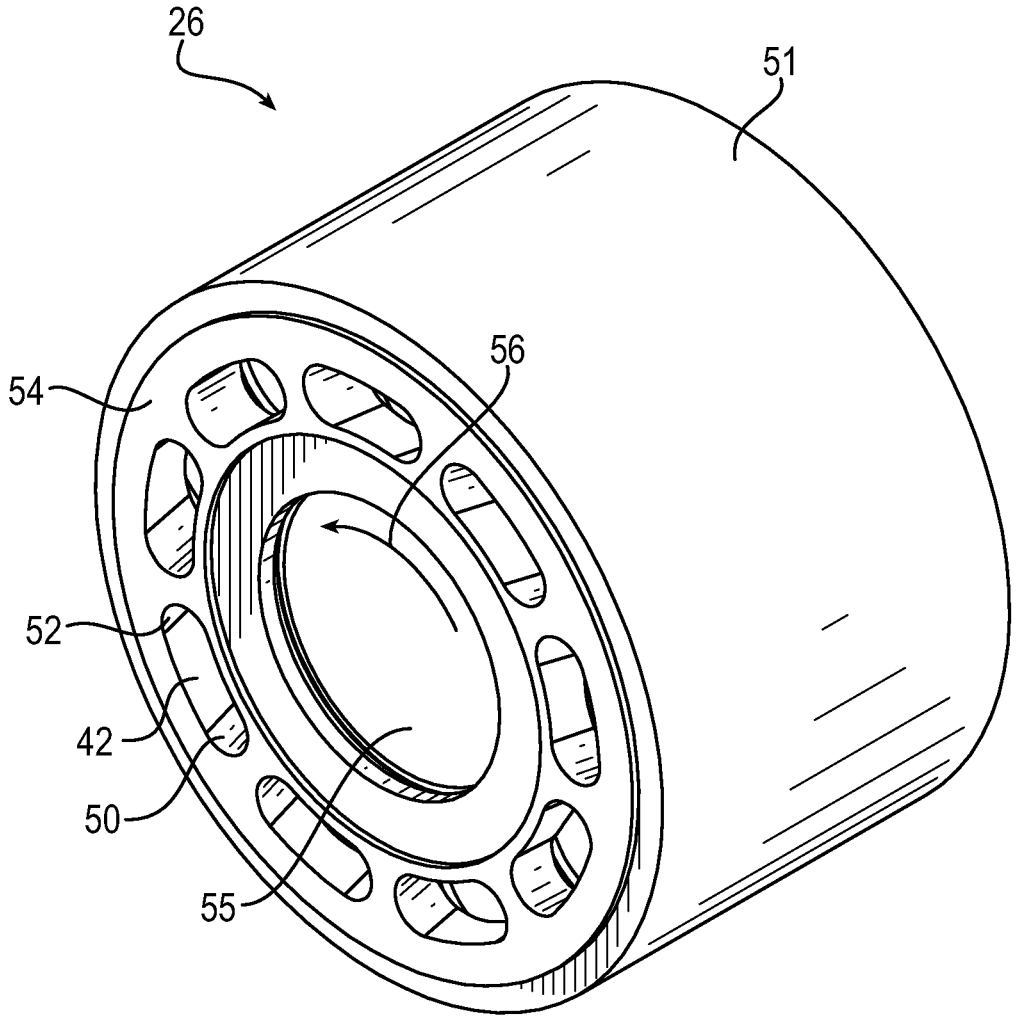
FIG. 4 is a drawing depicting a second perspective view of the exemplary pump barrel of FIG. 3 from an opposite viewpoint on the kidney port side.
Figure 5:
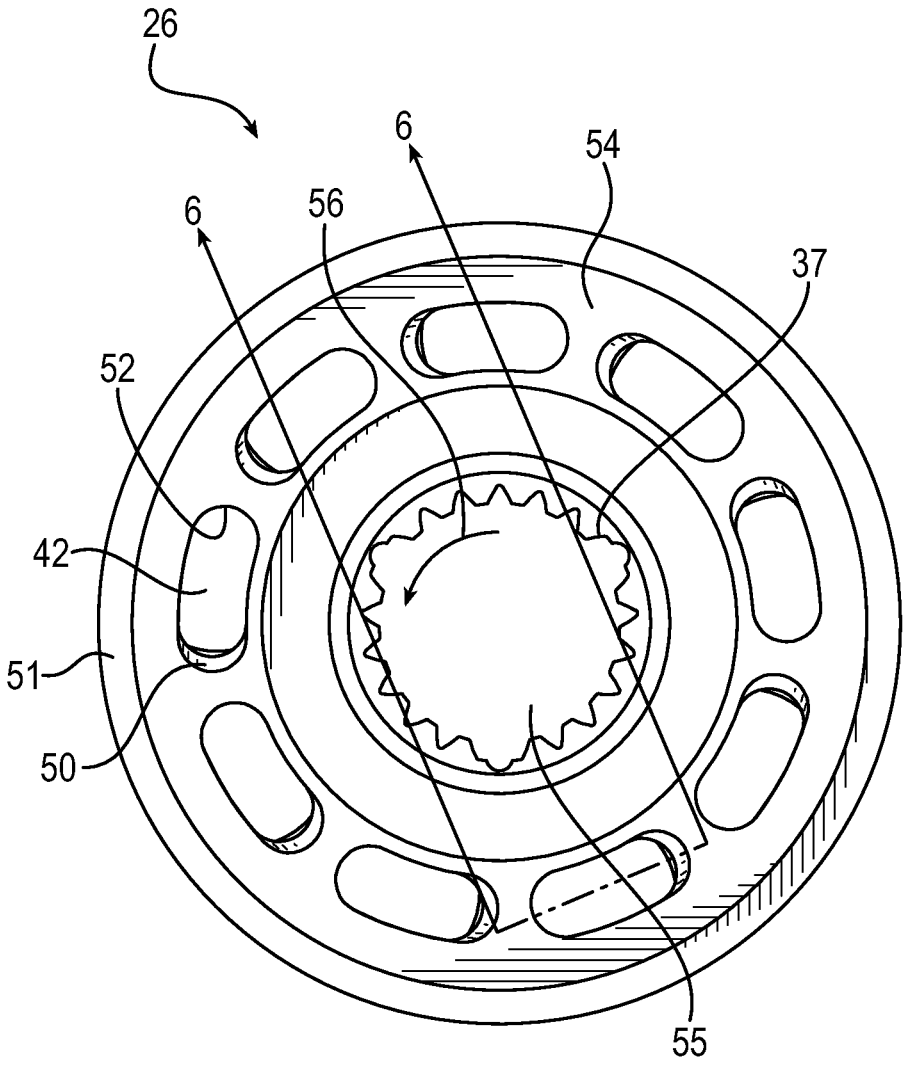
FIG. 5 is a drawing depicting a kidney port side view of the exemplary pump barrel of FIGS. 3 and 4.
Figure 6:
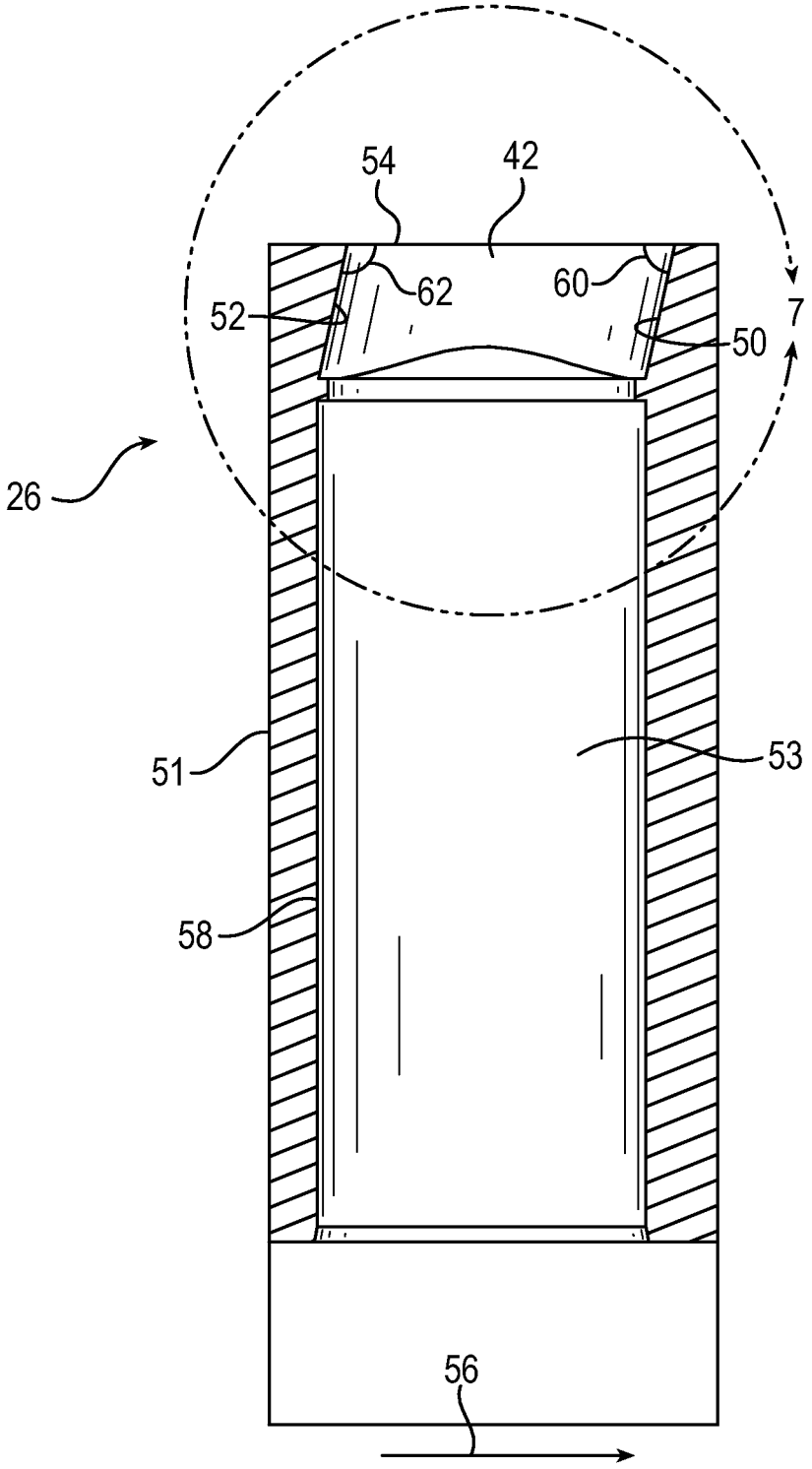
FIG. 6 is a drawing depicting a cross-sectional view of the exemplary pump barrel along the line 6-6 of FIG. 5.
Figure 7:
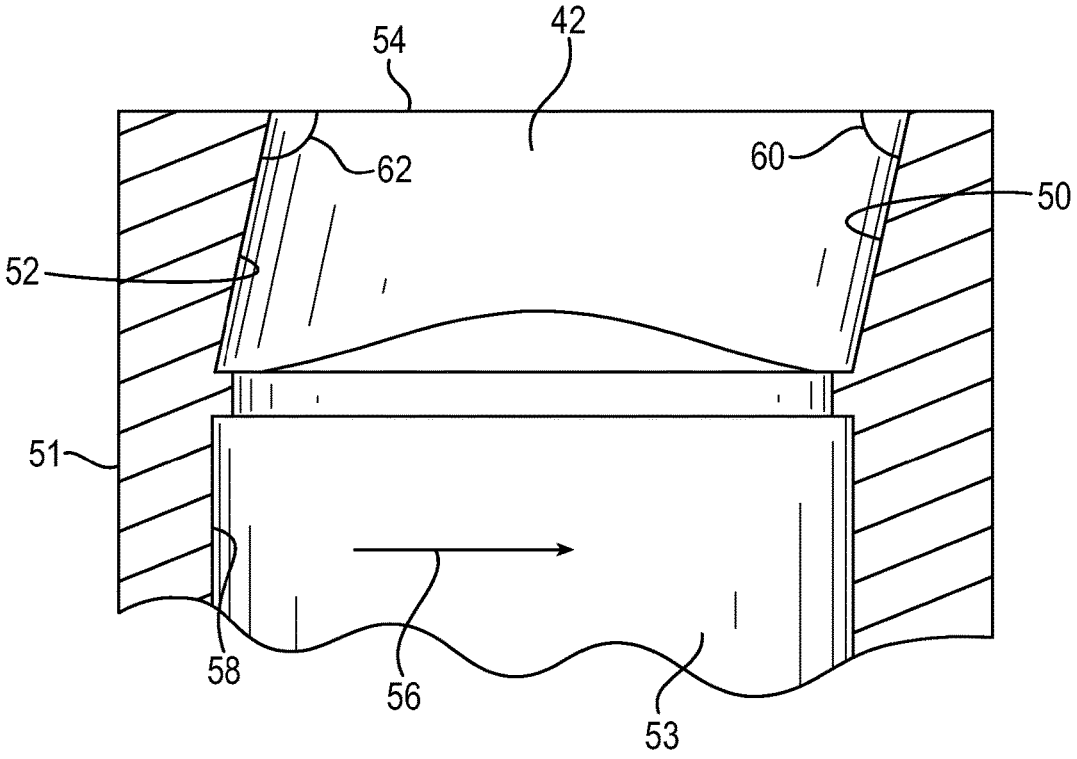
FIG. 7 is a drawing depicting a close-up view of the exemplary pump barrel within the line 7-7 of FIG. 6.

FIG. 4 is a drawing depicting a second perspective view of the exemplary pump barrel 26 of FIG. 3 from an opposite viewpoint from the kidney port side. FIG. 5 is a drawing depicting a straight-on view of the kidney port side of the exemplary pump barrel 26. FIG. 6 is a drawing depicting a cross-sectional view of the exemplary pump barrel 26 along the line 6-6 of FIG. 5, and FIG. 7 is a drawing depicting a close-up view of the portion of the exemplary pump barrel 26 within the line 7-7 of FIG. 6. Accordingly, like components are identified with common reference numerals in FIGS. 4-7.

As seen in such figures, the pump barrel 26 includes a porting face 54 that defines the plurality of pump kidney ports 42, which are in fluid communication with the bores 53 and piston chambers that receive the pistons. The number of kidney ports 42 corresponds to the number of pistons that are to be incorporated into the pump barrel 26. When the piston barrel 26 rotates under the driving of the input shaft, the porting face 54 rotates against the valve plate 38 of the manifold 28 referenced above. The arrows 56 in FIGS. 4 and 5 indicate an exemplary direction of rotation of the pump barrel 26. Relative to such rotation direction, each kidney port has a leading edge surface 50 and a trailing edge surface 52 as referenced generally above. The leading edge surface 50 and trailing edge surface 52 are sloped relative to a wall surface 58 of the respective bore 53 (see FIG. 6 in particular), or relative to a normal line that extends along an axis of movement of the piston 22.

As seen best in the close-up of FIG. 7, an arrow 56 again indicates the direction of rotation of the pump barrel 26. The direction of rotation again serves to define the leading edge surface 50 and trailing edge surface 52 of the kidney port 42. As seen in FIG. 7, both edge surfaces of the kidney ports 42 are oriented at non-right angles relative to the porting face 54. In particular, the leading edge surface 50 is oriented at a leading edge angle 60 relative to the porting face 54, and the leading edge angle 60 is less than 90°. On the opposite end of the kidney port 42, the trailing edge surface 52 is oriented at a trailing edge angle 62 relative to the porting face 54, and the trailing edge angle 62 is greater than 90°. This is in contrast to conventional configurations in which the leading and trailing edge surfaces are straight and not sloped, such that the leading and trailing edge angles relative to the porting face are both 90°.

The sloped nature of the kidney port surfaces of the present invention enhances the output flow as compared to conventional configurations, and thus results in a greater output power. The greater output power of the present invention, therefore, is achieved without changing the size of the piston rotating group, and without a multiple pump configuration.

In particular, the sloped barrel kidney port surfaces provide a better flow condition through the pump barrel. It is known that as the barrel rotates, a pressure differential is generated between the trailing edge surface and the leading edge surface of the kidney port. In other words, there is a buildup of elevated pressure at the trailing edge surface relative to a lower pressure at the leading edge surface. In the conventional configuration of straight barrel kidney port surfaces, the fluid chamber increasing in volume during retraction of the piston is the only driver for the working fluid to enter the piston fluid chamber. With increasing the speed, fluid inertia and viscosity become a limiting factor for increasing the output speed. In contrast, in the present invention the sloped angles of the trailing and leading edge surfaces operate to take advantage of the higher trailing edge pressure. The trailing edge slope uses the pressure differential to help push and move the fluid more easily and with greater speed into the piston chamber as compared to a straight barrel kidney port. Fluid flow resulting from the sloped kidney port surface, therefore, is not only forced by the piston motion, but also by a fluid inertia and centrifugal force which pushes the fluid inside the piston chamber along the inclined trailing edge surface of the kidney port.

By using the fluid inertia force in addition to piston movement, the present invention provides for increased self-priming speed as compared to conventional configurations. The result is enhanced fluid output flow from the pump, which in turn increases the output power.

Figure 8:
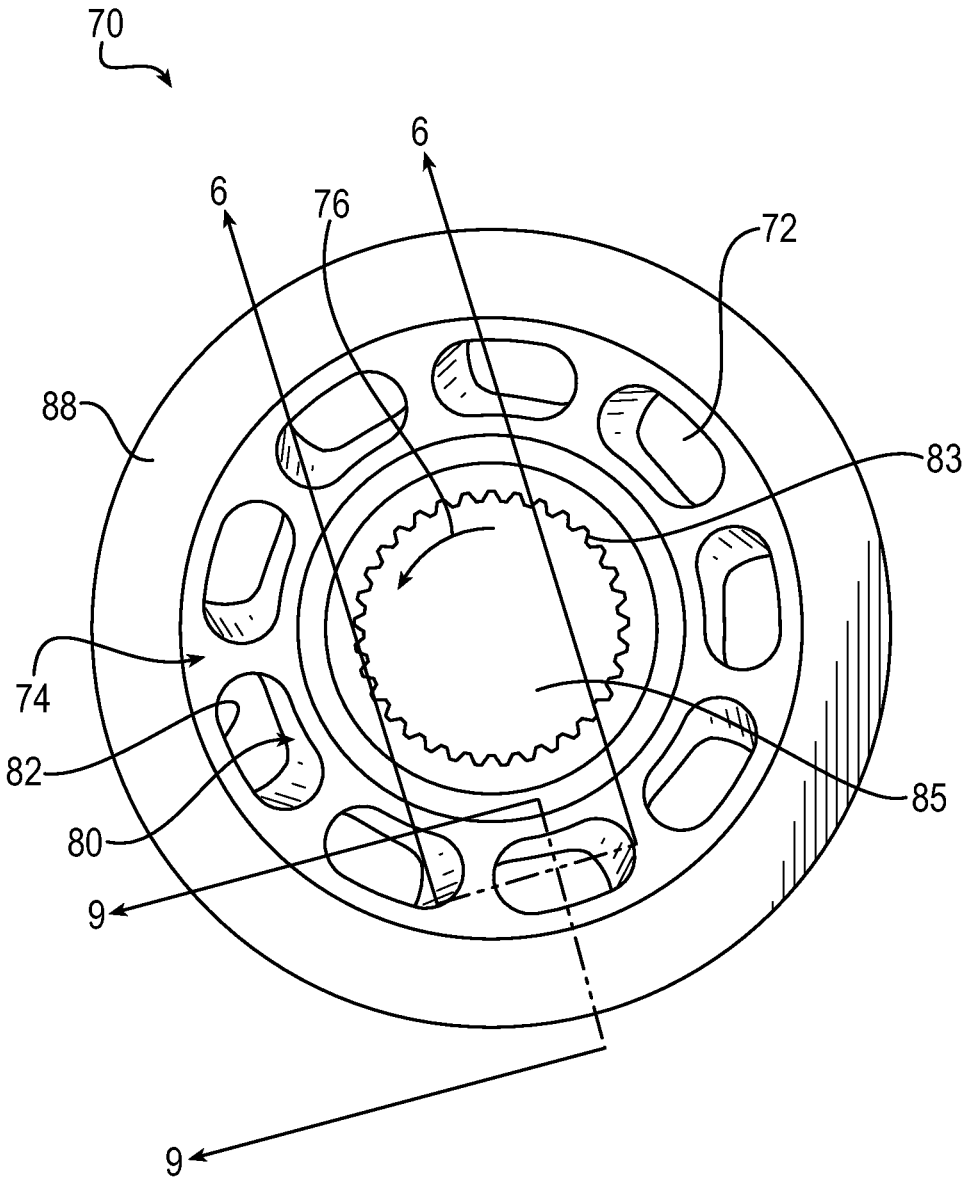
FIG. 8 is a drawing depicting a kidney port side view of a second exemplary pump barrel in accordance with embodiments of the present invention.
Figure 9:
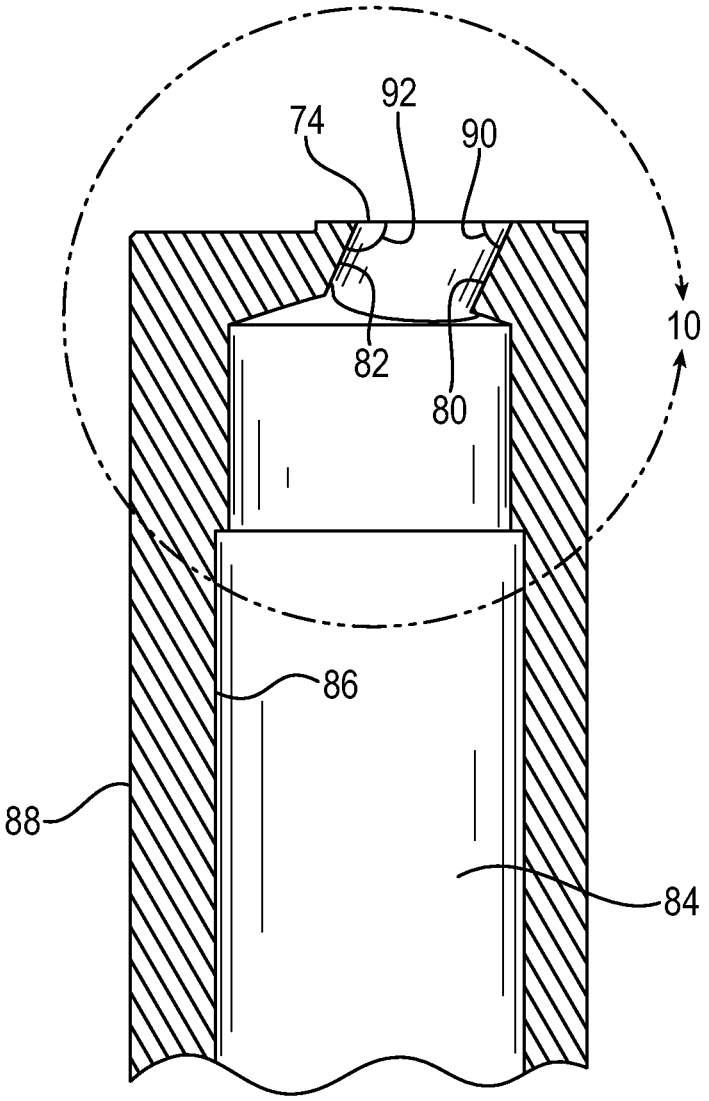
FIG. 9 is a drawing depicting a cross-sectional view of the second exemplary pump barrel along the line 9-9 of FIG. 8.
Figure 10:
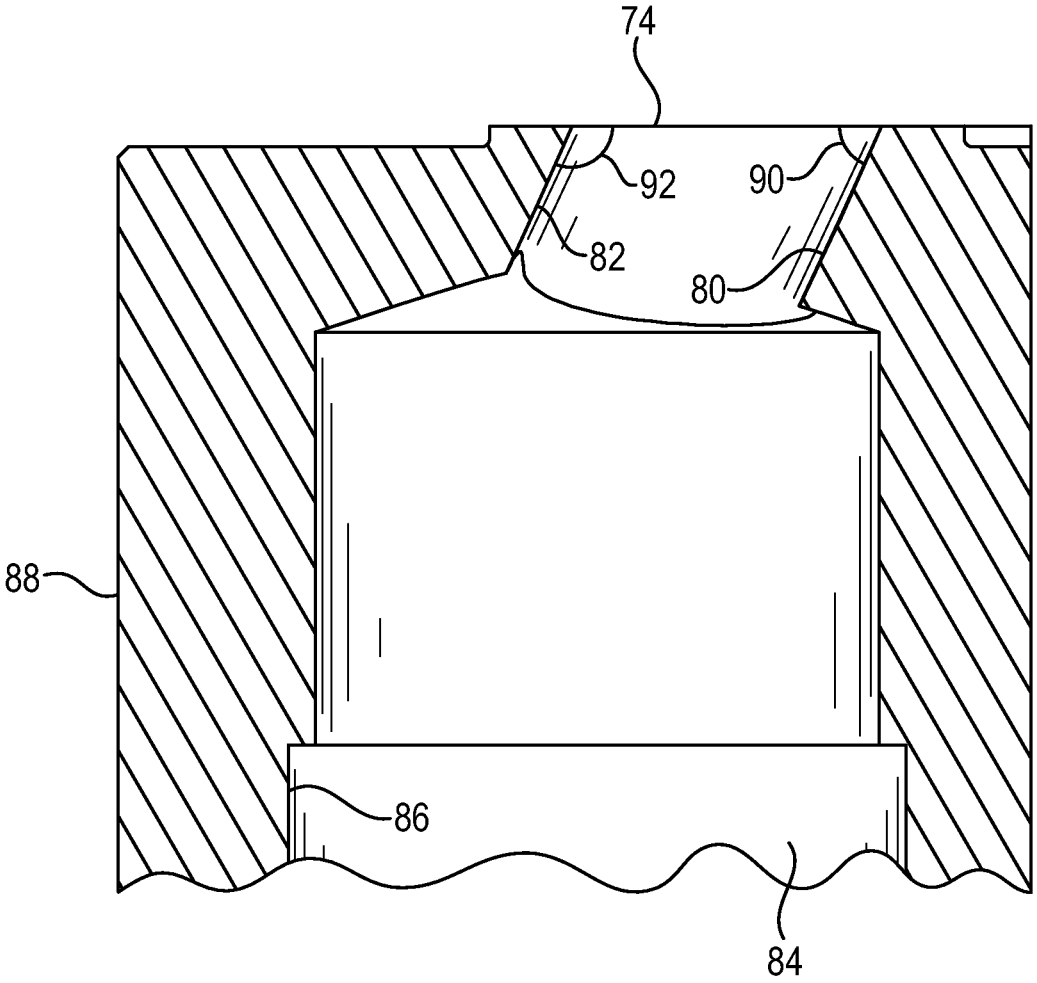
FIG. 10 is a drawing depicting a close-up view of the exemplary second pump barrel within the line 10-10 of FIG. 9.

In the exemplary pump barrel shown in FIGS. 5-7, the kidney ports are sloped in only one direction. In another exemplary embodiment, to enhance the fluid output flow further, the pump barrel kidney ports may be sloped in two directions. In particular, FIG. 8 is a drawing depicting a kidney port side view of a second exemplary pump barrel 70 in accordance with embodiments of the present invention. FIG. 9 is a drawing depicting a cross-sectional view of the second exemplary pump barrel 70 along the line 9-9 of FIG. 8. FIG. 10 is a drawing depicting a close-up view of the exemplary second pump barrel 70 within the line 10-10 of FIG. 9.

The pump barrel 70 of FIG. 8 essentially has comparable generalized features as the pump barrel 26 of the first embodiment, as depicted in FIGS. 3 and 4. As seen in FIG. 8, the pump barrel 70 similarly includes a porting face 74 that defines a plurality of pump kidney ports 72, which are in fluid communication with the bores and piston chambers that receive the pistons similarly as in the first embodiment. The number of kidney ports 72 corresponds to the number of pistons that are to be incorporated into the pump barrel 70. When the pump barrel 70 rotates under the driving of the input shaft, the porting face 74 rotates against the valve plate 38 of the manifold 28 referenced above (see FIGS. 1 and 2).

In the cross-sectional views of FIGS. 9-10, the exemplary direction of rotation of the pump barrel is essentially "out of the page" relative to the depiction of the illustrated portion of the pump barrel 70. In particular, relative to such rotation direction, each kidney port 72 has an inner edge surface 80 and an outer edge surface 82, with the terms "inner" and "outer" denoting location relative to a center of the pump barrel. Each kidney port 72 is in fluid communication with a respective bore 84 with wall surface 86 that is defined by the barrel body 88 (similarly as to FIGS. 5 and 6). The pump barrel 70 further includes a spline 83, which extends through a central bore 85 the piston barrel 70, and which interacts with the input shaft for driving the pump barrel. The kidney ports 72 and respective piston bores 84 may be spaced equidistantly around the central bore 85 comparably as in the previous embodiment.

The kidney ports in this embodiment of FIGS. 8-10 also are sloped in a first direction comparably as in the previous embodiment. This first sloped direction is indicated along the line 6-6 in FIG. 8, which essentially is the same as the sloping described with respect to the first embodiment along the line 6-6 of FIG. 5. The sloped nature in the first direction already has been described above with respect to FIGS. 6 and 7, and is comparable in the current embodiment.

In addition, in the embodiment of the pump barrel 70 of FIGS. 8-10, the kidney ports 72 further are sloped in a second direction that is different from the first direction. FIGS. 9 and 10 depict the manner by which the kidney ports are sloped in the second direction in addition the first direction. As referenced above, in the cross-sectional view of FIGS. 9-10, the exemplary direction of rotation of the pump barrel is essentially "out of the page" relative to the depiction of the illustrated portion of the pump barrel 70. In the second tilt orientation shown in FIGS. 9 and 10, the inner edge surface 80 and outer edge surface 82 are sloped relative to the wall surface 86 of the respective bore 84, or relative to a normal line that extends along an axis of movement of the piston. Both inner and outer edge surfaces of the kidney ports 72 are oriented at non-right angles relative to the porting face 74. In particular, the inner edge surface 80 is oriented at an inner edge tilt angle 90 relative to the porting face 74, and the inner edge tilt angle 90 is less than 90°. On the opposite end of the kidney port 72, the outer edge surface 82 is oriented at an outer edge tilt angle 92 relative to the porting face 74, and the outer edge tilt angle 92 is greater than 90°.

The sloped nature of the kidney port surfaces in both the first and second directions further enhances the output flow as compared to conventional configurations, and thus results in a greater output power. As in the first embodiment, the second embodiment having kidney ports sloped in first and second directions achieves the greater output power without changing the size of the piston rotating group, and without a multiple pump configuration.

An aspect of the invention is a pump barrel for use in a hydrostatic pump assembly. In exemplary embodiments, the pump barrel includes a barrel body defining a plurality of piston bores configured for receiving a plurality of pistons that are moveable within the bores, and a porting face that defines a plurality of ports that are in fluid communication with the piston bores and providing fluid flow paths into and out from the barrel body. Edge surfaces of the ports are oriented at non-right angles relative to the porting face.

In an exemplary embodiment of the pump barrel, each port has a leading edge surface and a trailing edge surface relative to a direction of rotation of the pump barrel.

In an exemplary embodiment of the pump barrel, the leading edge surface is oriented at an angle of less than 90° relative to the porting face, and the trailing edge surface is oriented at an angle greater than 90° relative to the porting face.

In an exemplary embodiment of the pump barrel, the barrel body is cylindrical.

In an exemplary embodiment of the pump barrel, the plurality of ports are kidney ports.

In an exemplary embodiment of the pump barrel, the piston bores are cylindrical.

In an exemplary embodiment of the pump barrel, a number of ports defined by the pump barrel corresponds to the number of bores.

In an exemplary embodiment of the pump barrel, the pump barrel further includes a central bore that includes a spline configured for interacting with an input drive shaft.

In an exemplary embodiment of the pump barrel, the plurality of piston bores are spaced equidistantly around the central bore.

In an exemplary embodiment of the pump barrel, edge surfaces of the ports are oriented in a first direction at non-right angles relative to the porting face, and oriented in a second direction comprising a tilt angle that is different from the first direction.

In an exemplary embodiment of the pump barrel, the tilt angle tilts the ports in a plane that is perpendicular to both the porting face and a plane of the non-right angles of the first direction.

In an exemplary embodiment of the pump barrel, each port has a leading edge surface and a trailing edge surface, and an inner edge surface and an outer edge surface.

In an exemplary embodiment of the pump barrel, the leading edge surface is oriented at a leading edge angle of less than 90° relative to the porting face, and the trailing edge surface is oriented at a trailing edge angle greater than 90° relative to the porting face; and the inner edge surface is oriented at an inner edge tilt angle of less than 90° relative to the porting face, and the outer edge surface is oriented at an outer edge tilt angle greater than 90° relative to the porting face.

Another aspect of the invention is a hydrostatic pump assembly. In exemplary embodiments, the hydrostatic pump assembly includes a piston rotating group including a pump barrel defining a plurality of bores, and a plurality of moveable pistons that are received in the plurality of bores of the pump barrel; an input shaft for driving rotation of the piston rotating group; and a displaceable swash plate. As the piston rotating group rotates, the pistons extend and contract by interaction against the swash plate to drive fluid into and out from the hydrostatic pump assembly. The pump barrel has a plurality of ports in fluid communication with the bores and providing fluid flow paths into and out from the pump barrel, and edge surfaces of the ports are sloped relative to a normal line extending along an axis of movement of the pistons.

In an exemplary embodiment of the hydrostatic pump assembly, each port has a leading edge surface and a trailing edge surface, and an inner edge surface and an outer edge surface.

In an exemplary embodiment of the hydrostatic pump assembly, the leading edge surface is oriented at a leading edge angle of less than 90° relative to the porting face, and the trailing edge surface is oriented at a trailing edge angle greater than 90° relative to the porting face; and the inner edge surface is oriented at an inner edge tilt angle of less than 90° relative to the porting face, and the outer edge surface is oriented at an outer edge tilt angle greater than 90° relative to the porting face.

In an exemplary embodiment of the hydrostatic pump assembly, a number of ports defined by the pump barrel corresponds to a number of pistons.

In an exemplary embodiment of the hydrostatic pump assembly, the plurality of ports of the pump barrel are kidney ports.

In an exemplary embodiment of the hydrostatic pump assembly, the hydrostatic pump assembly further includes a fluid manifold including an input passage and an output passage respectively for communicating the fluid to and from the piston rotating group, wherein the piston rotating group rotates against a pump running face of the manifold.

In an exemplary embodiment of the hydrostatic pump assembly, edge surfaces of the ports are sloped in a first direction relative to a normal line extending along an axis of movement of the pistons, and oriented in a second direction comprising a tilt angle that is different from the first direction.

In an exemplary embodiment of the hydrostatic pump assembly, the pump barrel has a porting face that defines the plurality of ports, and the tilt angle tilts the ports in a plane that is perpendicular to both the porting face and a plane of the sloping of the first direction.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

An example of such alternative embodiment could be a hydrostatic pump barrel piston arrangement where the pistons are titled relative to barrel rotational axis, so that the piston axis creates an angle with the barrel rotational axis. This arrangement is different from the above embodiment, where the pistons axis is parallel to the barrel axis. Another example of an alternative embodiment could be a barrel arrangement where the barrel porting face creates a spherical interface with a mating valve plate. In such arrangement, the barrel face has a concave contour while the valve plate face has a convex contour. Such configuration also is different from the above embodiment, where both mating faces are described as plain surfaces.

What is claimed is:

1. A pump barrel for use in a hydrostatic pump assembly, comprising:

a barrel body defining a plurality of piston bores configured for receiving a plurality of pistons that are moveable within the piston bores; and a porting face that defines a plurality of ports that are in fluid communication with the piston bores and providing fluid flow paths into and out from the barrel body;

wherein edge surfaces of the ports are oriented at non-right angles relative to the porting face; and wherein each port has a leading edge surface and a trailing edge surface relative to a direction of rotation of the pump barrel, and the leading edge surface is oriented at an acute angle of less than 90° relative to the porting face, and the trailing edge surface is oriented at an obtuse angle greater than 90° relative to the porting face.

2. The pump barrel of claim 1, wherein a number of the ports defined by the pump barrel corresponds to a number of the piston bores.

3. The pump barrel of claim 1, further comprising a central bore that includes a spline configured for interacting with an input drive shaft.

4. The pump barrel of claim 1, wherein the barrel body is cylindrical.

5. The pump barrel of claim 1, wherein the plurality of ports are kidney ports.

6. The pump barrel of claim 1, wherein the piston bores are cylindrical.

7. The pump barrel of claim 6, wherein the plurality of piston bores are spaced equidistantly around a central bore.

8. A hydrostatic pump assembly, comprising:

a piston rotating group including a pump barrel defining a plurality of bores, and a plurality of moveable pistons that are received in the plurality of bores of the pump barrel;

an input shaft for driving rotation of the piston rotating group; and a displaceable swash plate, wherein as the piston rotating group rotates, the pistons extend and contract by interaction against the swash plate to drive fluid into and out from the hydrostatic pump assembly; and wherein the pump barrel has a plurality of ports in fluid communication with the bores and providing fluid flow paths into and out from the pump barrel, and edge surfaces of the ports are sloped relative to a normal line extending along an axis of movement of the pistons;

and further wherein:

each port has a leading edge surface and a trailing edge surface relative to a direction of rotation of the piston rotating group;

the pump barrel has a porting face that defines the plurality of ports;

the leading edge surface of each port is oriented at an acute angle of less than 90° relative to the porting face; and the trailing edge surface of each port is oriented at an obtuse angle greater than 90° relative to the porting face.

9. The hydrostatic pump assembly of claim 8, wherein a number of the ports defined by the pump barrel corresponds to a number of the pistons.

10. The hydrostatic pump assembly of claim 8, wherein the plurality of ports of the pump barrel are kidney ports.

11. The hydrostatic pump assembly of claim 8, further comprising a fluid manifold including an input passage and an output passage respectively for communicating the fluid to and from the piston rotating group, wherein the piston rotating group rotates against a pump running face of the manifold.

12. A pump barrel for use in a hydrostatic pump assembly, comprising:

a barrel body defining a plurality of piston bores configured for receiving a plurality of pistons that are moveable within the piston bores; and a porting face that defines a plurality of ports that are in fluid communication with the piston bores and providing fluid flow paths into and out from the barrel body;

wherein edge surfaces of the ports are oriented in a first direction at non-right angles relative to the porting face, and oriented in a second direction comprising a tilt angle that is different from the first direction;

and further wherein:

the tilt angle tilts the ports in a plane that is perpendicular to both the porting face and a plane of the non-right angles of the first direction;

each port has a leading edge surface and a trailing edge surface relative to a direction of rotation of the barrel body, and has an inner edge surface and an outer edge surface;

the leading edge surface is oriented at a leading edge acute angle of less than 90° relative to the porting face, and the trailing edge surface is oriented at a trailing edge obtuse angle greater than 90° relative to the porting face; and the inner edge surface is oriented at an inner edge tilt acute angle of less than 90° relative to the porting face, and the outer edge surface is oriented at an outer edge tilt obtuse angle greater than 90° relative to the porting face.

13. The pump barrel of claim 12, wherein the barrel body is cylindrical.

14. The pump barrel of claim 12, wherein the plurality of ports are kidney ports.

15. The pump barrel of claim 12, wherein the piston bores are cylindrical.

16. The pump barrel of claim 12, wherein a number of the ports defined by the pump barrel corresponds to a number of the piston bores.

17. The pump barrel of claim 12, further comprising a central bore that includes a spline configured for interacting with an input drive shaft.

18. The pump barrel of claim 17, wherein the plurality of piston bores are spaced equidistantly around the central bore.

19. A hydrostatic pump assembly, comprising:

a piston rotating group including a pump barrel according to claim 12 and the plurality of moveable pistons that are received in the plurality of bores of the pump barrel;

an input shaft for driving rotation of the piston rotating group; and a displaceable swash plate, wherein as the piston rotating group rotates, the pistons extend and contract by interaction against the swash plate to drive fluid into and out from the hydrostatic pump assembly.

20. The hydrostatic pump assembly of claim 19, further comprising a fluid manifold including an input passage and an output passage respectively for communicating the fluid to and from the piston rotating group, wherein the piston rotating group rotates against a pump running face of the manifold.

* * * * *